US006843471B2

(12) United States Patent
Hara

(10) Patent No.: US 6,843,471 B2
(45) Date of Patent: Jan. 18, 2005

(54) JETTING APPARATUS FOR MIXED FLOW OF GAS AND LIQUID

(75) Inventor: Shinichi Hara, Kanazawa (JP)

(73) Assignee: Shibuya Kogyo Co., Ltd., Ishikawa (JP)

( * ) Notice: Subject to any disclaimer, the term of this patent is extended or adjusted under 35 U.S.C. 154(b) by 100 days.

(21) Appl. No.: 10/077,930

(22) Filed: Feb. 20, 2002

(65) Prior Publication Data

US 2002/0113327 A1 Aug. 22, 2002

(30) Foreign Application Priority Data

Feb. 21, 2001 (JP) ..... P2001-045829
Aug. 30, 2001 (JP) ..... P2001-262218

(51) Int. Cl.[7] ..... B01F 3/04
(52) U.S. Cl. ..... 261/76; 261/116
(58) Field of Search ..... 261/76, 77, 115, 261/116

(56) References Cited

U.S. PATENT DOCUMENTS 790,888 A * 5/1905 Ferris ..... 73/202
1,071,875 A * 9/1913 Buschei ..... 417/176
3,707,067 A * 12/1972 Dietrick ..... 96/241
3,881,898 A * 5/1975 Darby et al. ..... 96/275
3,938,326 A * 2/1976 DeCorso et al. ..... 60/723
4,014,961 A * 3/1977 Popov ..... 261/76
4,824,614 A * 4/1989 Jones ..... 261/76
4,880,447 A * 11/1989 Bloch ..... 95/225
5,465,848 A * 11/1995 Veh et al. ..... 209/170

FOREIGN PATENT DOCUMENTS

| | | |
|---|---|---|
| DE | 195 39 606 A1 | 5/1997 |
| EP | 0 305 251 A1 | 3/1989 |
| EP | 1 072 307 A2 | 1/2001 |
| JP | 11-333725 | 12/1999 |

* cited by examiner

*Primary Examiner*—Scott Bushey
(74) *Attorney, Agent, or Firm*—Sughrue Mion, PLLC

(57) ABSTRACT

A jetting apparatus for mixing at least liquid and gas to create the mixed flow of the gas and the liquid to thereby jet the mixed flow is provided. The jetting apparatus has a passage of the mixed flow of the gas and the liquid, the passage including at least one partition and a plurality of sub-passages divided by the partition, and liquid injection ports being provided in correspondence with the divided sub-passages. Mass flow per sectional area of the mixed flow of the gas and the liquid passing through the respective sub-passages is substantially equal.

8 Claims, 15 Drawing Sheets

JETTING APPARATUS FOR MIXED FLOW OF GAS AND LIQUID

The present application is based on Japanese Patent Applications No. 2001-045829 and 2001-262218, which are incorporated herein by reference.

BACKGROUND OF THE INVENTION

1. Field of the Invention

The present invention relates to a jetting apparatus for a mixed flow of gas and liquid which is widely applicable as a jetting nozzle for various use, such as a nozzle for cleaning vehicles, walls of buildings, bottles, dishes, etc.

2. Description of the Related Art

As a conventional jetting apparatus of this type, there has been widely known a jetting apparatus having a single jetting port in a circular or a flat shape to jet a mixed flow of gas and liquid. However, in case where the jetting port has a circular shape, there exist differences in strength of blowing action between a central area and a peripheral area of the mixed flow of the gas and the liquid, and therefore, it has been a technical problem that blowing variations may occur in an area where the central part of the flow having strong blowing action passes and an area where the central part does not pass. On the other hand, in case where the jetting port has a flat shape, wide and efficient blow can be made. However, in this case too, it has not been easy to create a uniform jet flow so that the blowing action may be uniform in the central area and the peripheral area. Particularly, in case where the jetting apparatus is constructed in such a manner capable of varying jetting condition, it has been technically difficult to set the jetting condition so that the blowing action may be always uniform in both the central area and the peripheral area under any jetting condition.

SUMMARY OF THE INVENTION

The present invention has been made in view of the circumstances as described above, and an object of the invention is to provide a jetting apparatus for a mixed flow of gas and liquid which has less blowing variations, can generate efficient blowing, and is convenient for use, by making blowing action of the mixed flow of the gas and the liquid uniform.

In order to solve the above described problems, in a jetting apparatus according to the invention for a mixed flow of gas and liquid which is so constructed as to mix at least liquid and gas to create the mixed flow of the gas and the liquid and jet it, the jetting apparatus comprising: a passage of the mixed flow of the gas and the liquid, said passage including at least one partition and a plurality of sub-passages divided by said partition; and liquid injection ports being provided in correspondence with said divided sub-passages; wherein mass flow per sectional area of the mixed flow of the gas and the liquid passing through said respective sub-passages is substantially equal. In the present invention, the passage of the mixed flow of the gas and the liquid is formed flat, and an inside of the passage is divided by the partitions into a plurality of streams (sub-passages) to supply the liquid from the liquid injection ports corresponding to the respective sub-passages. Accordingly, the streams of the mixed flow of the gas and the liquid in the respective sub-passages can be properly created as predetermined. In other words, considering number of the liquid injection ports to be provided, injection conditions, positional relation between the positions of the liquid injection ports and the aforesaid partitions and so on, the mass flow per sectional area of the streams of the mixed flow of the gas and the liquid in the respective sub-passages can be made substantially equal. It is thus possible to easily obtain a flat mixed flow of the gas and the liquid having less blowing variations, favorable in uniformity, and having a wide blowing range.

Moreover, each of the divided sub-passages may be gradually increased in a downstream direction in width in a direction in which the sub-passages are arranged. Also, each of the divided sub-passages may be gradually increased in a downstream direction in width in a direction perpendicular to a direction in which the sub-passages are arranged. Further, terminal ends of the partitions maybe located at an intermediate position in the passage of the mixed flow of the gas and the liquid. Still further, upstream ends of the partitions can be located at an appropriate distance from the liquid injection ports. Still further, by gradually decreasing sectional area of a gas passage for supplying the gas to the passage of the mixed flow of the gas and the liquid toward a supply port of the gas to increase injection rate of the gas, deceleration of the liquid injected from the aforesaid injection port can be restrained. Still further, by providing the passage of the mixed flow of the gas and the liquid with a minimum throttle portion which has the smallest sectional area, and making sectional area in the downstream part thereof equal to that of the minimum throttle portion or gradually increased, it is possible to restrain deceleration of the mixed flow of the gas and the liquid or accelerate it in the respective passages.

The jetting apparatus according to the present invention can be widely applied as a jetting nozzle for various use, such as a nozzle for cleaning vehicles, walls of buildings, bottles, dishes, etc. or a nozzle for painting and so on. As the liquid to be injected to the aforesaid passage, normal water such as running water, or cleansing liquid added with additives such as surface active agent, according to necessity, to improve cleaning power and disinfecting ability, and other appropriate liquid can be used. Although pressure for supplying the liquid may be as high as the running water, high discharge pressure from a high pressure pump may be employed. As for the gas, the jetting apparatus may be so constructed to suck the atmosphere by ejector action of a liquid jet flow injected to the passage of the mixed flow. Alternatively, pressurized gas such as compressed air, or high temperature and high pressure gas such as high temperature gas or vapor may be used. Moreover, in addition to the aforesaid liquid and gas, appropriate powder or particles such as sodium bicarbonate or abrasive agent may be admixed to these liquid and gas prior to supplying, or may be fed to the passage from a separate supply port.

Either a single or a plurality of partitions may be provided to divide the aforesaid mixed flow of the gas and the liquid. Specifically, it would be sufficient to divide a flowing space of the mixed flow of the gas and the liquid in two or more to create a plurality of passages (sub-passages). As for a position in which the upstream ends of the partitions are to be located, it would be sufficient to divide the passage for the mixed flow of the gas and liquid. For example, it is possible to provide the upstream ends of the partitions at an appropriate distance from the liquid injection ports, to provide the upstream ends of the partitions at the same position as the liquid injection ports so that the upstream ends of the partitions may be in contact with the liquid injection ports, or to provide the upstream ends of the partitions forward of the ports so that the liquid injection ports may open rearward of the upstream ends of the partitions. Sectional areas of the respective passages divided by the partitions are not necessarily the same, but it is possible to divide the passage in such a manner that the divided passages may have respectively different sectional areas to change number of the corresponding ports of the mixed flow of the gas and the liquid to be provided, and to vary diameters of the ports. In short, it would be sufficient that mass flow per sectional area of the mixed flow of the gas and the liquid passing through the respective passages are substantially equal. A manner of providing the partitions, specific shapes of the ports, and the number of the ports to be provided may be optionally selected. In order to obtain a wide range of jetting, it is possible to increase the partitions in number by widening the passage of the mixed flow of the gas and the liquid or forming the passage in a diverged shape having a wide angle.

Further, the partitions need not always be provided up to a tip end of the nozzle portion, but the terminal ends of the partitions may be located at an intermediate position in the passage of the mixed flow of the gas and the liquid. With such arrangement, streams of the mixed flow of the gas and the liquid which have been divided by the aforesaid partitions join together at the intermediate position between the terminal ends of the partitions and the injection ports in the downstream part, and boundaries existing between these streams of the mixed flow of the gas and the liquid will be eliminated. Accordingly, a more favorable jet flow having no boundary can be obtained, and strip-like blowing due to the boundaries between the streams of the mixed flow of the gas and the liquid can be appropriately avoided. In this connection, the terminal ends of the aforesaid partitions may be formed in a step-like shape, an inclined shape or a bifurcated shape, as shown in the embodiments described below. In such cases, sudden merging of the streams of the mixed flow of the gas and the liquid in the respective passages occurring at the terminal ends of the partitions will be moderated, and therefore, more smooth merging of the mixed flow of the gas and the liquid can be attained.

As for the liquid injection ports for injecting the liquid to the aforesaid passages, one or a plurality of liquid injection ports for each passage (sub-passage) may be provided. In this case, the liquid injection ports may be arranged in parallel in a plurality of rows in a vertical direction. For example, two liquid injection ports arranged in each row in a vertical direction may be provided corresponding to the respective passages. It is also possible to vary the number of the liquid injection ports for the respective passages, or vary injection amounts flowing from the respective liquid injection ports. In short, it would be sufficient that the mass flow per sectional area of the streams of the mixed flow of the gas and the liquid passing through the respective passages may be substantially equal. For example, it is possible to arrange two liquid injection ports in the central passage, and three each of the liquid injection ports may be arranged in the passages on both sides. As for a shape of the liquid injection ports, an appropriate shape such as circle, rectangular or slit-like shapes can be employed. Desirably, these liquid injection ports are directed so that the jet streams may not get in touch with wall faces near inlets of the passages. In a case where the liquid injection ports are arranged in parallel in a plurality of rows in a vertical direction as described above, the passage may be divided vertically and horizontally, by providing horizontal partitions in addition to vertical partitions in correspondence with the arrangement of these liquid injection ports. In this manner, in case where the passage is divided vertically and horizontally by providing the horizontal partitions as well as the vertical partitions, terminal ends of one or both of the vertical and horizontal partitions may be provided at an intermediate position in the passage, or the terminal ends may be in a step-like shape or an inclined shape as described above.

Features and advantages of the invention will be evident from the following detailed description of the preferred embodiments described in conjunction with the attached drawings.

DETAILED DESCRIPTION OF THE PREFERRED EMBODIMENTS

Figure 1:
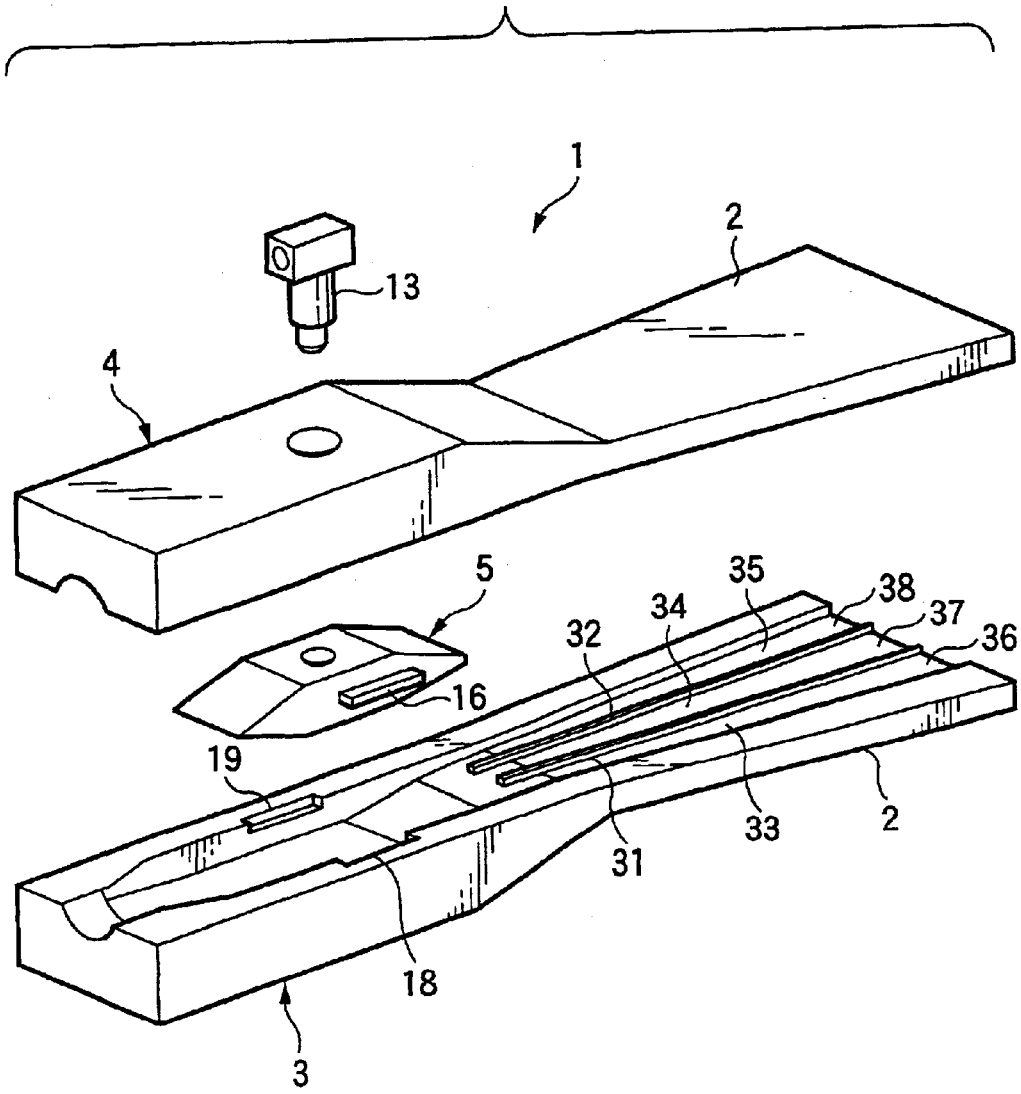
FIG. 1 is an exploded view for assembly schematically showing a first embodiment according to the present invention.
Figure 2:
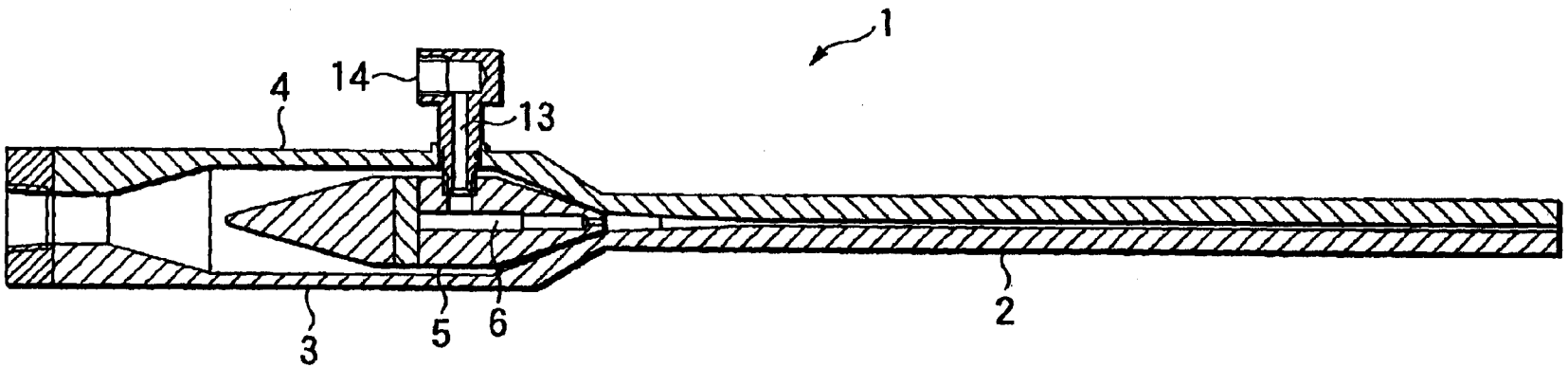
FIG. 2 is a longitudinal sectional view of the same embodiment.
Figure 3:
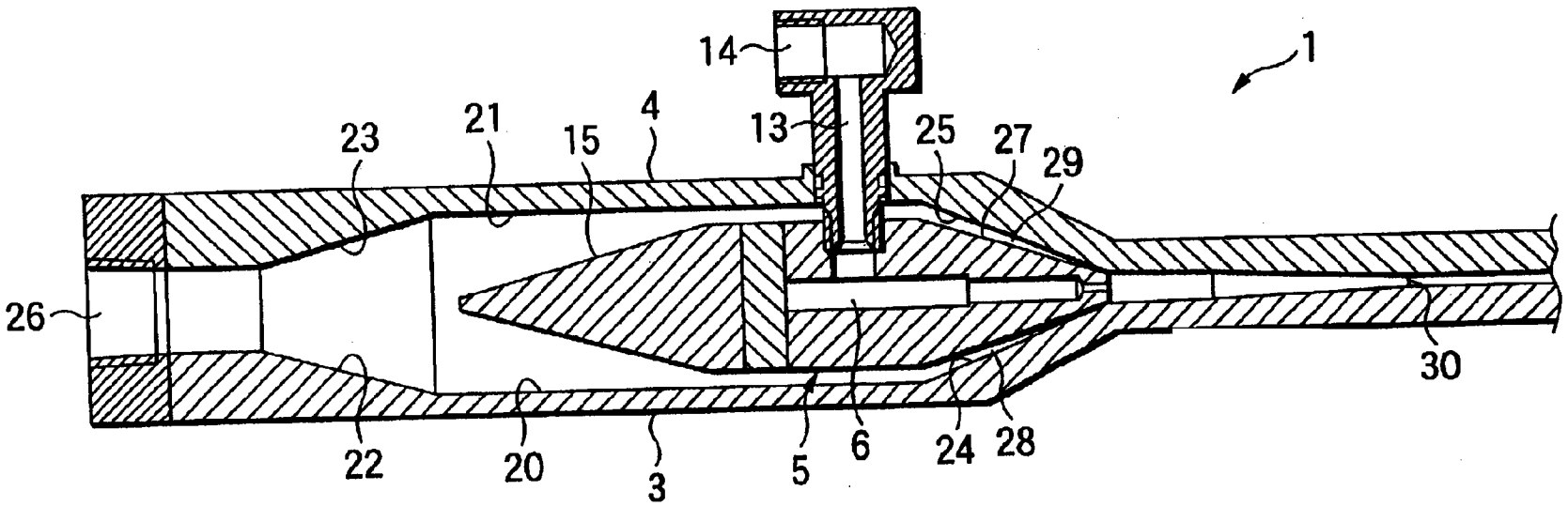
FIG. 3 is an enlarged view of a part of FIG. 2.
Figure 4:
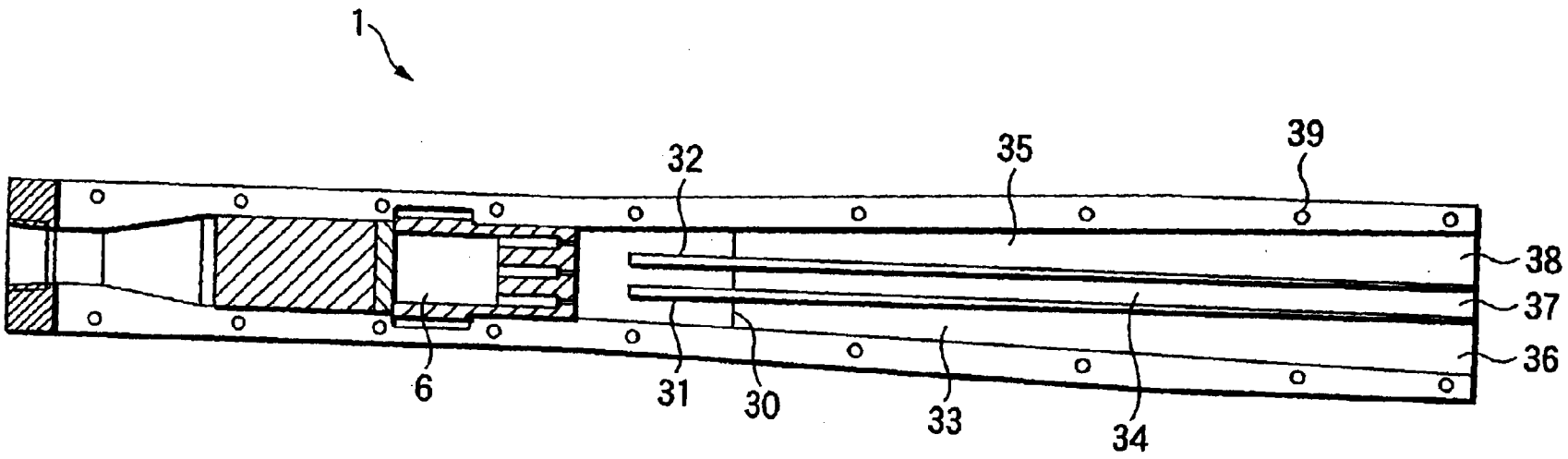
FIG. 4 is a sectional view in a horizontal direction of the same embodiment.
Figure 5:
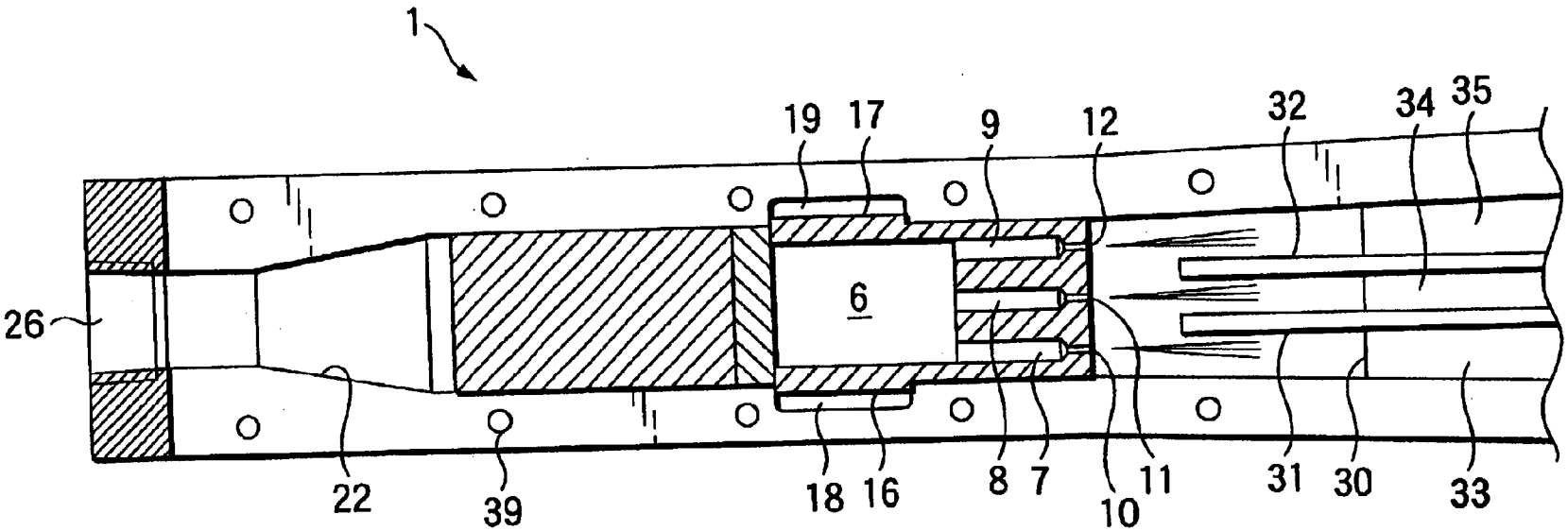
FIG. 5 is an enlarged view of a part of FIG. 4.
Figure 6:
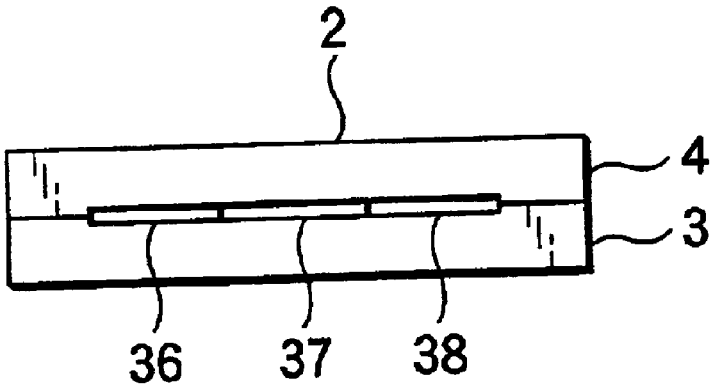
FIG. 6 is an enlarged view showing jetting ports in the same embodiment.

Now, an embodiment of the present invention will be described referring to the drawings. FIG. 1 is an exploded view for assembly schematically showing a first embodiment according to the present invention. FIG. 2 is a longitudinal sectional view of the same embodiment, and FIG. 3 is an enlarged view of a part of FIG. 2. FIG. 4 is a sectional view in a horizontal direction of the same embodiment, and FIG. 5 is an enlarged view of a part of FIG. 4. FIG. 6 is an enlarged view showing jetting ports in the same embodiment. As shown in the drawings, a jetting apparatus 1 in this embodiment includes a nozzle portion 2 having a long size, and is constructed by assembling a lower body 3 and an upper body 4 while a liquid supply portion 5 is provided in a space formed in an upstream part between them. The liquid supply portion S is constructed by assembling a plurality of components, and a flat reservoir portion 6 is formed in a central part thereof. In the present embodiment, three liquid injection ports 10 to 12 are formed in a distal end portion by way of three passages 7 to 9 extended from the flat reservoir portion 6, as shown in FIG. 5. A liquid supply passage 13 is provided above the flat reservoir portion 6 in communication therewith, so that pressurized liquid is supplied from a pressurized liquid supply source, which is not shown, by way of a connecting portion 14. A tapered portion 15 is formed in an upstream part of the liquid supply portion 5 so as not to inhibit a flow of the gas. Moreover, engaging projections 16, 17 are formed on both sides of the liquid supply portion 5 and adapted to be engaged with engaging recesses 18, 19 which are formed in both or one of the lower body 3 and the upper body 4 according to cases, thereby to position both the bodies.

In this embodiment, the aforesaid lower body 3 and the upper body 4 are formed substantially symmetrically except an area where the liquid supply passage 13 is to be inserted, as shown in FIG. 3, and are provided with inclined faces 22, 23 and inclined faces 24, 25 in rear and in front of recesses 20, 21 which define a mounting space of the liquid supply portion 5. There is also formed a connecting portion 26 for pressurized gas in continuation with the inclined faces 22, 23 in the upstream part so as to supply the pressurized gas from a pressurized gas supply source which is not shown. Moreover, a tapered portion 27 formed in a downstream part of the liquid supply portion 5 is arranged inside the inclined faces 24, 25 in the downstream part, and gas passages 28, 29 whose sectional area is reduced toward a supply port are formed between these inclined faces 24, 25 and the tapered portion 27. In case of this embodiment, the pressurized gas from the gas passages 28, 29 is injected to the liquid jet streams injected from the aforesaid liquid injection ports 10 to 12 from above and below, and the liquid and gas may be injected to the respective passages in such a manner that the liquid jet streams are respectively surrounded by the gas jet streams.

Then, characteristic features of the present invention will be described. As shown in the drawings, in the downstream part of the aforesaid liquid injection ports 10 to 12 and the gas passages 28, 29, there is formed a minimum throttle portion 30 which has the smallest sectional area so that in a space upstream of this minimum throttle portion 30, mixture of the liquid injected from the liquid injection ports 10 to 12 and the gas injected from the gas passages 28, 29 may be promoted, and creation of the mixed flow of the gas and the liquid may start. An upper and lower walls of this space upstream of this minimum throttle portion 30 are tapered to form inclined faces so as to gradually reduce sectional area in a downstream direction so that mixing action of the gas and the liquid may be promoted, and the liquid in a drop like shape may be restrained from deceleration. As shown in FIG. 4 and FIG. 5, the space is formed flat having a large width along a direction in which the liquid injection ports 10 to 12 are arranged. In this embodiment, partitions 31, 32 are provided from an intermediate position toward the downstream part to divide the mixed flow of the gas and the liquid into a plurality of passages (sub-passages) 33 to 35. In other words, in the aforesaid wide and flat space, there is created a flat stream of the mixed flow of the gas and the liquid, and the flat stream of the mixed flow of the gas and the liquid is divided by the partitions 31, 32 and introduced to respective jetting ports 36 to 38 by way of the passages 33 to 35. With this arrangement, the mixed flow of the gas and the liquid can be accurately and stably distributed to the passages 33 to 35 as predetermined, and blowing variations occurring between the central area and the peripheral area can be properly eliminated with respect to the generally flat mixed flow of the gas and the liquid which has been formed by the jet streams from the jetting ports 36 to 38.

When positioning the partitions 31, 32, positions of the upstream ends of the partitions 31, 32, that is, positional relation between the liquid injection ports 10 to 12 and forward ends of the partitions 31, 32, and a distance between the partitions 31 and 32 may be set, so that the streams of the mixed flow of the gas and the liquid flowing through the respective passages 33 to 35 may be substantially equal in their mass flow per sectional area, considering injection condition of the liquid from the liquid injection ports 10 to 12, injection condition of the gas from the gas passages 28, 29, and a mixed state of the mixed flow of the gas and the liquid. As the results, the mass flow per sectional area of the streams of the mixed flow of the gas and the liquid to be jetted from the jetting ports 36 to 38 will be substantially equal, and a uniform and favorable state of injection can be obtained. For information, the mixed flow of the gas and the liquid flowing down through the passages 33 to 35 divided by the partitions 31, 32 is further promoted to be mixed while flowing down, and jetted from the jetting ports 36 to 38 to the exterior as the mixed flow of the gas and the liquid in a more favorably mixed state. Although the sectional areas of the respective passages 33 to 35 are designed in this embodiment to be gradually increased in the downstream direction from the minimum throttle portion 30, it is possible to set the sectional area to be constant. It is also possible to position the foremost ends of the respective passages 33 to 35 at a position of the minimum throttle portion. For information, in case where the sectional area is increased from the minimum throttle portion in the downstream direction, flow rate of the mixed flow of the gas and the liquid can be accelerated, and it is possible to accelerate the flow rate of the mixed flow of the gas and the liquid as fast as or even faster than the speed of sound like a Laval nozzle.

As shown in FIG. 4, the partitions 31, 32 in this embodiment are formed to become gradually thin in thickness in the downstream direction so as to minimize gaps between the adjacent jetting ports 36 to 38. These partitions 31, 32 can be formed by shaving, integrally molded by casting or the like, or can be additionally provided afterward in both or either one of the lower body 3 and the upper body 4. Although the three passages 33 to 35 are formed by the partitions 31, 32 in correspondence with the three liquid injection ports 10 to 12 in this embodiment, it is needless to say that the number of the partitions can be altered according to cases. As shown in FIG. 6, the jetting ports 36 to 38 are provided in such a manner that the downstream ends of the passages 33 to 35 are open as they are, to form the flat jetting ports. However, a single jetting port in an appropriate shape such as a circular or a rectangular shape may be formed in a central part of the downstream ends of the respective passages 33 to 35, or a plurality of jetting ports may be provided in parallel along the downstream ends of these passages 33 to 35. Further, the terminal ends of the partitions 31, 32 may be located at an intermediate position of the passages 33 to 35 of the mixed flow of the gas and the liquid. In this case, at the intermediate position between the terminal ends of the partitions 31, 32 and the injection ports downstream thereof, the streams of the mixed flow of the gas and the liquid divided by the partitions 31, 32 are joined together to eliminate boundaries between the streams, enabling a boundless jet flow to be jetted from a single jetting port. Numeral 39 represents a bolt tightening hole for integrally tightening the lower body 3 and the upper body 4.

Figure 7:
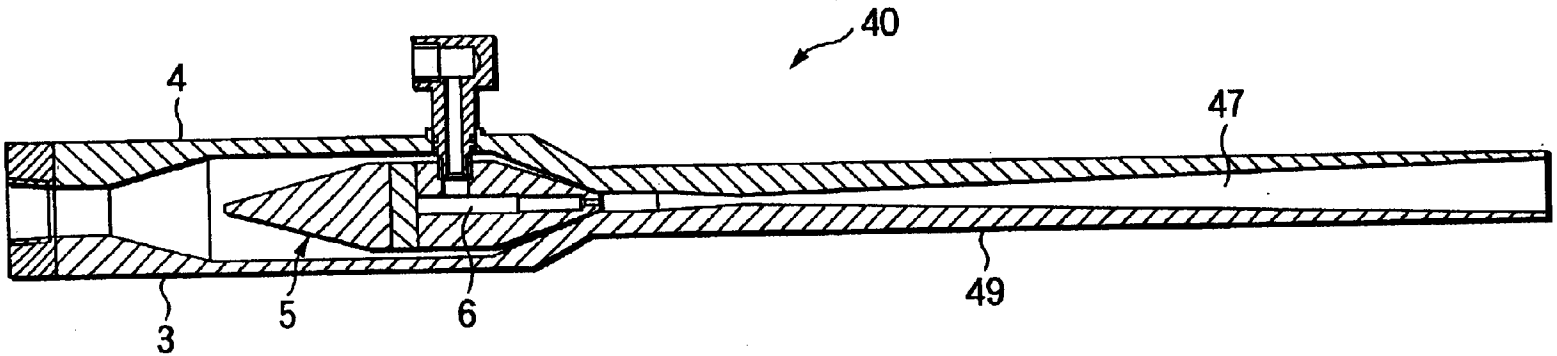
FIG. 7 is a longitudinal sectional view of a second embodiment according to the present invention.
Figure 8:
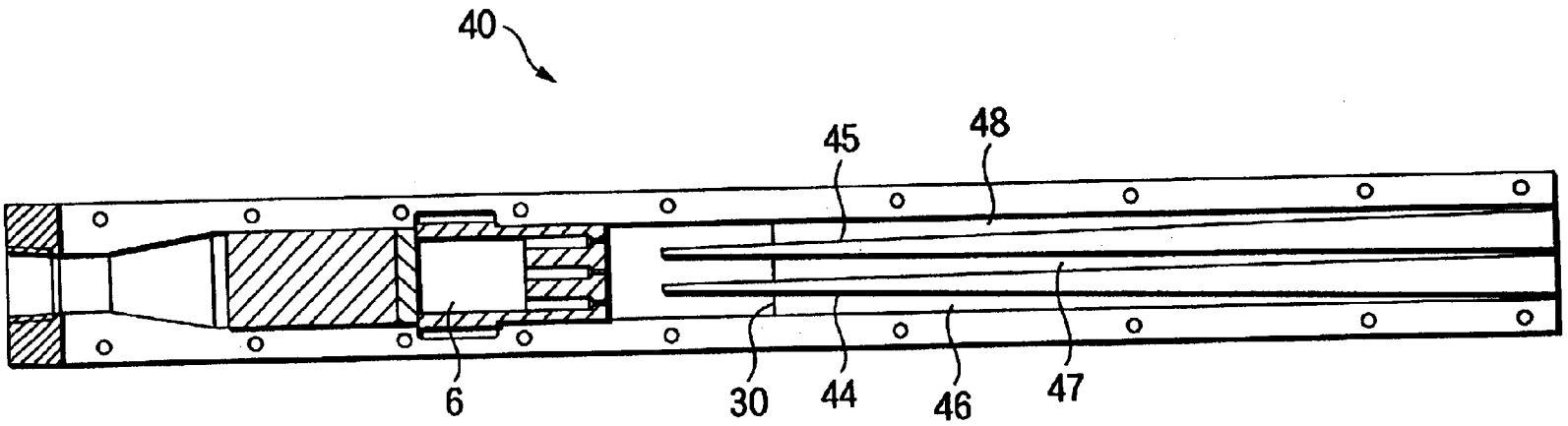
FIG. 8 is a sectional view in a horizontal direction of the same embodiment.
Figure 9:
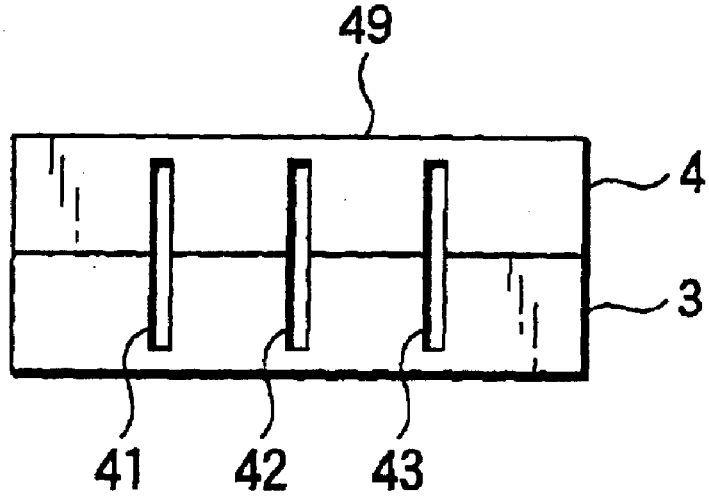
FIG. 9 is an enlarged view of jetting ports in the same embodiment.

FIG. 7 is a longitudinal sectional view showing a second embodiment according to the present invention, FIG. 8 is a sectional view in a horizontal direction of the same embodiment, and FIG. 9 is an enlarged view showing jetting ports. A jetting apparatus 40 in this embodiment is a modification of the aforesaid first embodiment, and characterized in that the jetting ports 41 to 43 are changed into parallel arrangement as shown in FIG. 9. For this purpose, the partitions 44, 45 in this embodiment are formed to become gradually larger in thickness in the downstream direction as shown in FIG. 8 so that passages (sub-passages) 46 to 48 formed by the partitions 44, 45 are continued to the jetting ports 41 to 43 and width of the passages 46 to 48 are gradually decreased toward the jetting ports 41 to 43. Moreover, as shown in FIG. 7, height of the passages 46 to 48 is made gradually higher in the downstream direction so as to be continued to the jetting ports 41 to 43, and height of the aforesaid partitions 44, 45 is also gradually increased in the downstream direction correspondingly. In other words, the width of these passages 46 to 48 in a vertical direction are gradually increased in the downstream direction so that the passages 46 to 48 may become flat having a large width in a direction intersecting a direction in which the passages 46 to 48 are arranged. Accordingly, the height of a nozzle portion 49 in this jetting apparatus 40 is set to be larger than in the case of the aforesaid first embodiment. Further, according to this embodiment, although the nozzle portion 49 may be moved along a direction of the flat jetting ports 41 to 43, the nozzle portion 49 can be moved along the direction intersecting the jetting ports 41 to 43, that is, the direction in which these jetting ports 41 to 43 are arranged. In this manner, flat streams of the mixed flow of the gas and the liquid from the jetting ports 41 to 43 are jetted in parallel, and a single jet stroke can conduct a plurality of times of blowing corresponding to the number of the jetting ports provided, for example, three times of blowing at a time, in this embodiment, by the mixed flow of the gas and the liquid from the jetting ports 41 to 43.

Figure 10:
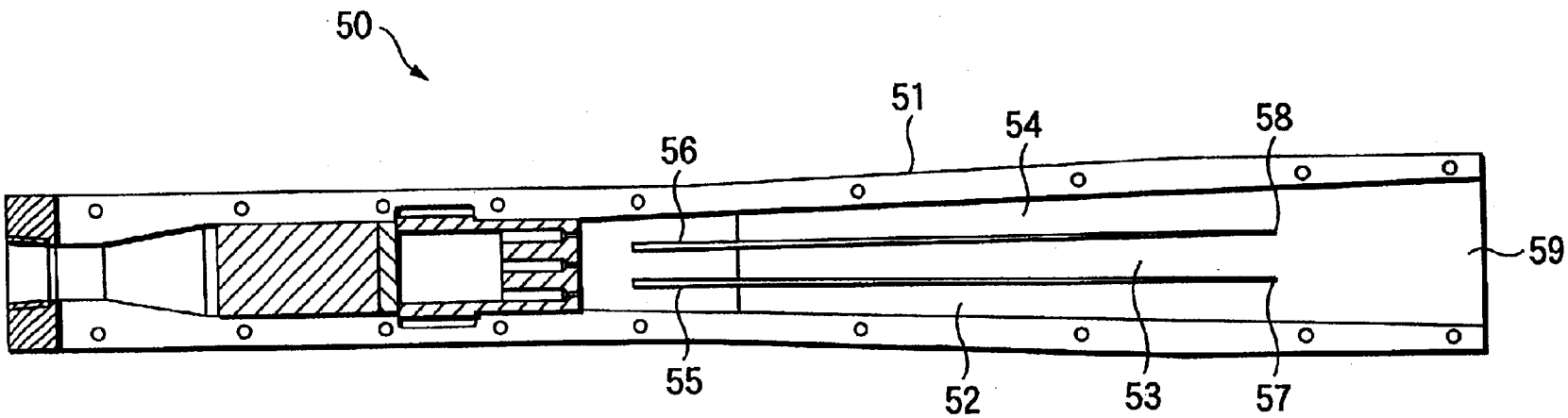
FIG. 10 is a sectional view in a horizontal direction showing a third embodiment according to the present invention.
Figure 11:
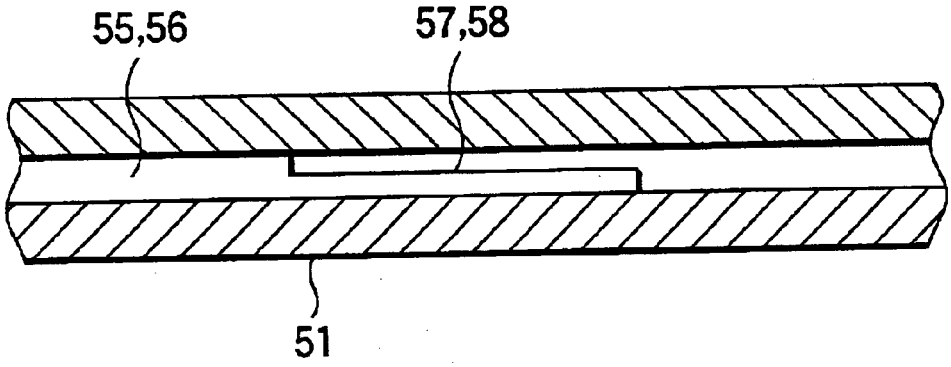
FIG. 11 is a longitudinal sectional view showing terminal ends of partitions in the same embodiment.
Figure 12:
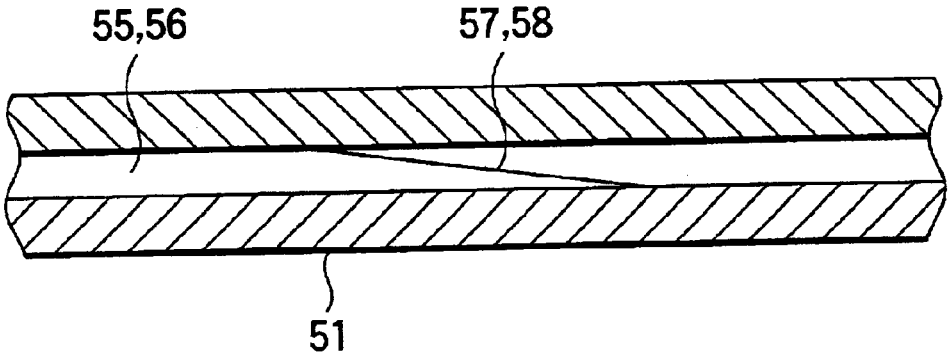
FIG. 12 is a longitudinal sectional view showing a modification of the terminal ends of the partitions in an enlarged scale.

FIG. 10 is a sectional view in a horizontal direction showing a third embodiment according to the present invention, and FIG. 11 is a longitudinal sectional view showing the same embodiment partly enlarged. A jetting apparatus 50 in this embodiment is a modification of the aforesaid first embodiment, and characterized in that terminal ends 57, 58 of partitions 55, 56 for dividing the passage of the mixed flow of the gas and the liquid into three passages (sub-passages) 52 to 54 are located at an intermediate position in an upstream part of a jetting port 59 as shown in FIG. 10, and as described above, the streams of the mixed flow of the gas and the liquid divided by the partitions 55, 56 are merged in a downstream part of the terminal ends 57, 58 to eliminate boundaries between the streams, enabling a boundless jet flow to be jetted from a single jetting port. As shown in FIG. 11, the terminal ends 57, 58 of the partitions 55, 56 in this embodiment are formed in a step-like shape. By thus setting a mixing area at the terminal ends 57, 58 of the partitions 55, 56 to be longer, sudden merging can be moderated, and more smooth merging of the mixed flow of the gas and the liquid can be attained. For information, in case where the terminal ends 57, 58 of the partitions 55, 56 are formed in an inclined shape as shown in FIG. 12, sudden merging can be also moderated in the same manner, and more smooth merging of the mixed flow of the gas and the liquid can be obtained.

Figure 13:
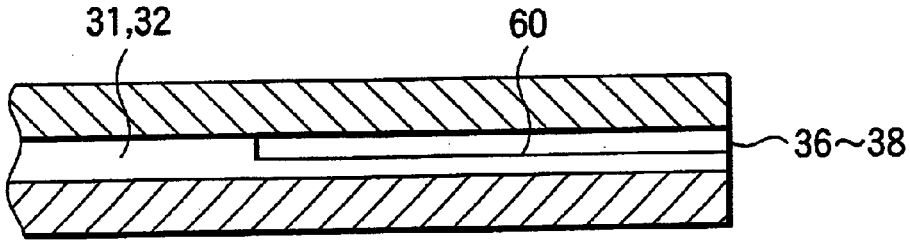
FIG. 13 is a longitudinal sectional view showing in an enlarged scale a nozzle portion in a forth embodiment according to the present invention.
Figure 14:
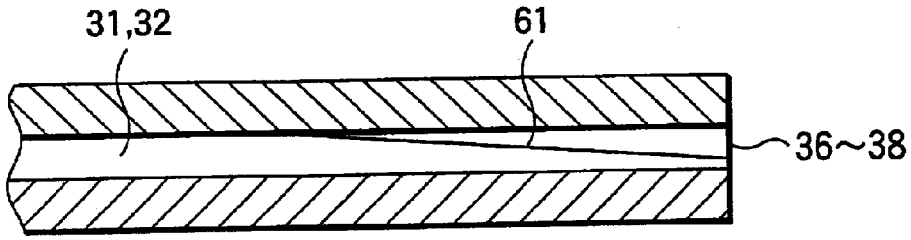
FIG. 14 is a longitudinal sectional view showing a modification of the same embodiment.
Figure 15:
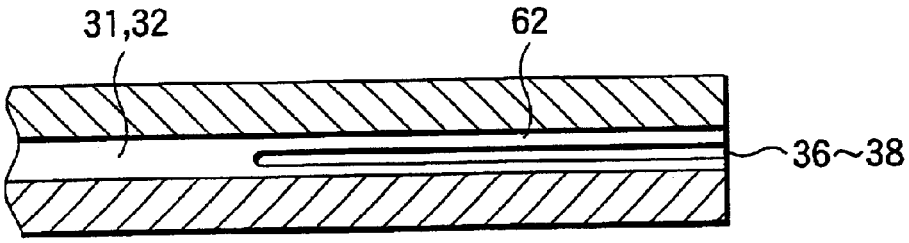
FIG. 15 is a longitudinal sectional view showing another modification of the same embodiment.

FIG. 13 is a longitudinal sectional view showing a nozzle portion in a fourth embodiment according to the present invention in an enlarged scale. The present embodiment is a modification of the aforesaid first embodiment, and a step 60 is formed in the downstream part of the aforesaid partitions 31, 32. This embodiment is characterized in that a rearward part of the step 60 is extended up to the aforesaid jetting ports 36 to 38, and the respective streams of the mixed flow of the gas and the liquid which have been divided by the partitions 31, 32 are jetted from the jetting ports 36 to 38 while the streams are partially merged in the downstream part of these passages (sub-passages), lightening or eliminating the boundaries between the respective streams of the mixed flow of the gas and the liquid. In place of the step 60, a slanted part 61 as shown in FIG. 14 or a bifurcated part 62 as shown in FIG. 15 may be employed.

Figure 16:
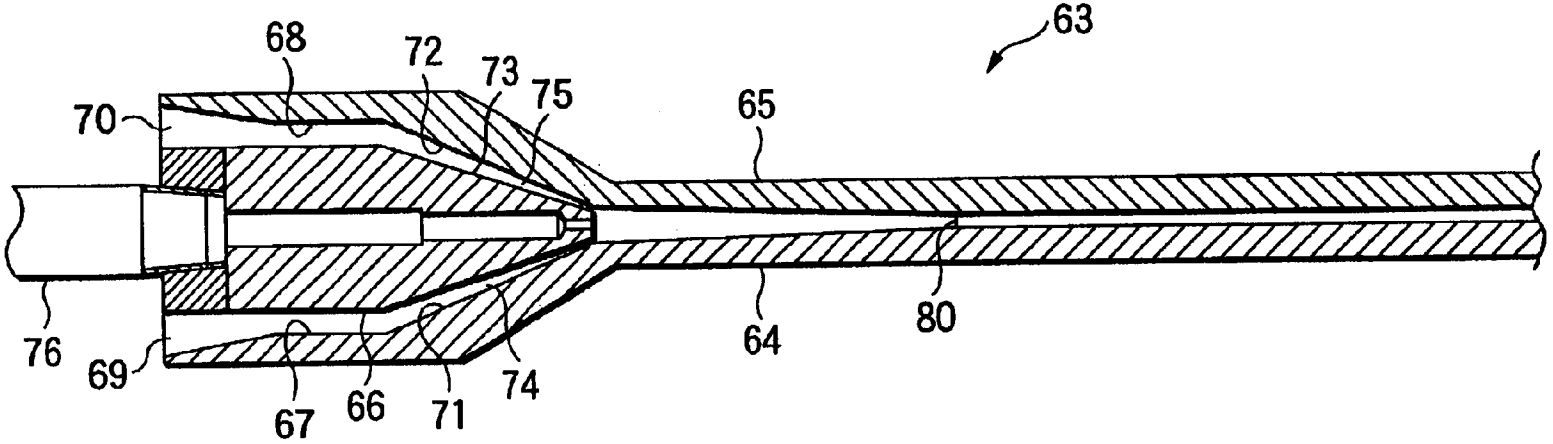
FIG. 16 is a longitudinal sectional view showing an essential part of a fifth embodiment according to the present invention.
Figure 17:
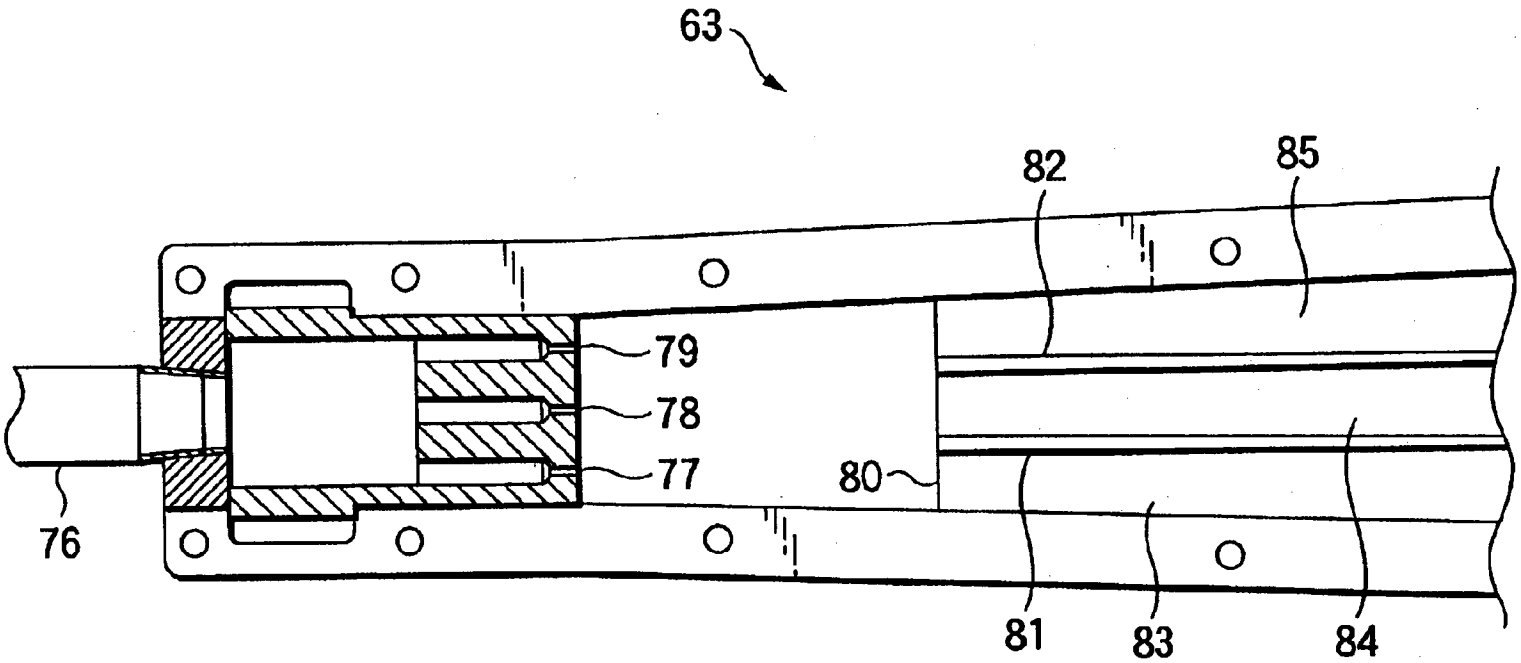
FIG. 17 is a sectional view in a horizontal direction showing the essential part of the same embodiment.
Figure 18:
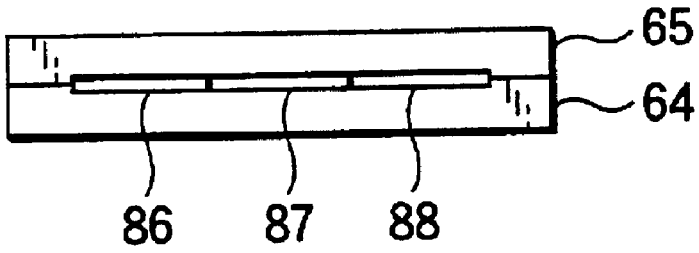
FIG. 18 is an enlarged view showing jetting ports in the same embodiment.

FIG. 16 is a longitudinal sectional view showing a fifth embodiment according to the present invention, FIG. 17 is a sectional view in a horizontal direction of the same embodiment, and FIG. 18 is an enlarged view showing jetting ports. In contrast with the aforesaid first embodiment, a jetting apparatus 63 in this embodiment is characterized in that a manner of supplying the gas is changed to a system for sucking the atmosphere. In other words, in the jetting apparatus 63 in this embodiment, a lower body 64 and an upper body 65 are formed substantially symmetrically, and there are formed suction inlets 69, 70 in an upstream part of recesses 67, 68 defining a space for mounting a liquid supply portion 66, and inclined faces 71, 72 in a downstream part of the recesses. Inside the inclined faces 71, 72 in the downstream part, is arranged a tapered portion 73 which is formed in the downstream part of the liquid supply portion 66, thereby to form gas passages 74, 75 between the inclined faces 71, 72 and the tapered portion 73 so that the sectional area may be gradually decreased toward a supply port. In case of this embodiment, the liquid supplied to the liquid supply portion 66 through a pressurized liquid supply tube 76 is injected from liquid injection ports 77 to 79, and the atmosphere is sucked from the suction ports 69, 70 by ejector action of their liquid jet streams and injected through the gas passages 74, 75. In a space in the upstream part of a minimum throttle part 80 having the smallest sectional area, these liquid and air are mixed to create a flat mixed flow of the gas and the liquid, which will flow down through passages 83 to 85 (sub-passages) divided by partitions 81, 82 down to jetting ports 86 to 88. The streams of the mixed flow of the gas and the liquid will be further promoted to be mixed while they flow down through the passages 83 to 85, and injected from the jetting ports 86 to 88 to the exterior as a flat flow of the mixed gas and liquid in a state favorably mixed. In this embodiment too, it is possible to make a single jetting port, and to locate terminal ends of the partitions 81, 82 at an intermediate position in the upstream part of the jetting port, so as to merge the mixed flow of the gas and the liquid at the position between the terminal ends of these partitions 81, 82 and the injection port, and jet it as a single jet flow without a boundary. Further, in place of the gas passages 74, 75 which are formed in a peripheral part of the aforesaid liquid supply portion 66, there may be provided a gas passage, which is not shown, communicating with a space between the liquid injection ports 77 to 79 and the minimum throttle part 80. By constructing in this manner, the gas can be sucked by way of the gas passage by a negative pressure occurring in the aforesaid space by ejector action of the liquid jet streams from the liquid injection ports 77 to 79.

Because the passage of the mixed flow of gas and liquid is formed flat in the present invention, and the flat passage is divided by the partitions into a plurality of passages (sub-passages) so that the mass flow per sectional area of the streams of the mixed flow of the gas and the liquid in the respective passages (sub-passages) are substantially equal, a flat jet flow which has favorable uniformity can be properly and stably created. In addition, it is also possible to locate the terminal ends of the partitions for dividing the passage at an intermediate position in the passage in the upstream part of the injection port, merging the respective streams of the mixed flow of the gas and the liquid which have been divided by the partitions to eliminate boundaries existing between the respective streams, and to jet the merged flow from the single jetting port as a favorable jet flow without a boundary.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A jetting apparatus for mixing at least liquid and gas to create the mixed flow of the gas and the liquid to thereby jet the mixed flow, said jetting apparatus comprising:

a passage of the mixed flow of the gas and the liquid, said passage including at least one partition and a plurality of sub-passages divided by said partition;

an inclined face connected to said passage;

a liquid supply portion provided adjacent to said inclined face, said liquid supply portion having liquid injection ports being provided in correspondence with said divided sub-passages and a tapered portion located inside said inclined face; and a gas passage defined between said tapered portion and said inclined face for supplying the gas to said passage, of which a sectional area is reduced toward the passage;

wherein mass flow per sectional area of the mixed flow of the gas and the liquid passing through said respective sub-passages is substantially equal.

2. A jetting apparatus according to claim 1, wherein each of said divided sub-passages is gradually increased in a downstream direction in width in a direction in which said sub-passages are arranged.

3. A jetting apparatus according to claim 1, wherein a downstream terminal end of said at least one partition is located at an intermediate position in said passage of said mixed flow of the gas and the liquid.

4. A jetting apparatus according to claim 1, wherein said upstream end of said at least one partition is located at an appropriate distance from said liquid injection ports.

5. A jetting apparatus according to claim 1, wherein a sectional area of said gas passage is gradually decreased toward a supply port for supplying gas to the passage.

6. A jetting apparatus according to claim 1, wherein said passage of the mixed flow of the gas and the liquid is provided with a minimum throttle portion which has the smallest sectional area, and sectional area of said passage in the downstream part thereof is made equal to that of said minimum throttle portion or gradually increased.

7. The jetting apparatus according to claim 1, wherein said partition includes a wall portion extending in a flow direction of said sub-passages.

8. A jetting apparatus according to claim 1, wherein each of said divided sub-passages is gradually increased in a downstream direction in width in a direction perpendicular to a direction in which said sub-passages are arranged.

* * * * *